US005505506A

United States Patent [19]

Kleefeldt

[11] Patent Number: 5,505,506

[45] Date of Patent: Apr. 9, 1996

[54] MOTOR-VEHICLE DOOR LATCH WITH COMPOSITE HOUSING

[75] Inventor: Frank Kleefeldt, Heiligenhaus, Germany

[73] Assignee: Kiekert GmbH & Co. KG, Heiligenhaus, Germany

[21] Appl. No.: 198,438

[22] Filed: Feb. 18, 1994

[30] Foreign Application Priority Data

Feb. 27, 1993 [DE] Germany ..... 43 06 142.7

[51] Int. Cl.[6] ..... E05C 3/26

[52] U.S. Cl. ..... 292/337; 292/216; 292/DIG. 38

[58] Field of Search ..... 70/216, 337, DIG. 23, 70/DIG. 38, DIG. 53, DIG. 64

[56] References Cited

U.S. PATENT DOCUMENTS

| | | | |
|---|---|---|---|
| 734,296 | 7/1903 | Burger | 109/82 |
| 3,876,238 | 4/1975 | Waterman | 292/216 |
| 4,470,626 | 9/1984 | Gergoe et al. | 292/DIG. 53 |
| 4,538,845 | 9/1985 | Yamada | 292/337 |
| 4,650,231 | 3/1987 | Shimura et al. | 411/546 |
| 4,775,176 | 10/1988 | Ikeda | 292/337 |
| 4,898,414 | 2/1990 | Yamada | 292/DIG. 38 |
| 4,971,373 | 11/1990 | Hamada et al. | 292/DIG. 56 |
| 5,172,946 | 12/1992 | Dowling | 292/216 |
| 5,308,128 | 5/1994 | Portelli et al. | 292/DIG. 56 |
| 5,328,219 | 7/1994 | Konchan et al. | 292/DIG. 38 |

FOREIGN PATENT DOCUMENTS

| | | | |
|---|---|---|---|
| 0230878 | 9/1989 | Japan | 292/337 |
| 2240583 | 8/1991 | United Kingdom | 292/DIG. 23 |

*Primary Examiner*—Darnell M. Boucher
*Attorney, Agent, or Firm*—Herbert Dubno; Andrew Wilford

[57] ABSTRACT

A motor-vehicle door latch has a molded synthetic-resin housing having a floor side plate, a perimeter wall projecting laterally from an inside face of the plate, and a cover plate. The housing is unitarily formed with a plurality of pivots. Mechanism inside the housing includes a latching fork, a latching pawl, and operating levers mounted on respective pivots. A metal reinforcing plate is imbedded in the floor side plate only in the region of the fork and pawl and is unitarily formed with upstanding tabs extending into and imbedded in the pivots of the fork and pawl only. The pivots of the operating levers are substantially wholly formed of the plastic of the housing.

9 Claims, 3 Drawing Sheets

FIG. 1a
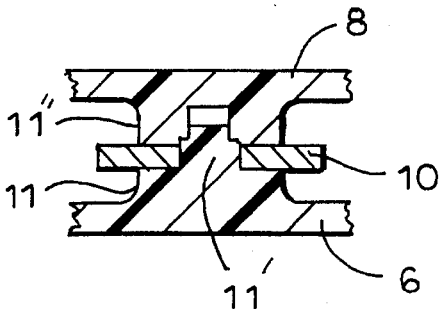
FIG. 1b
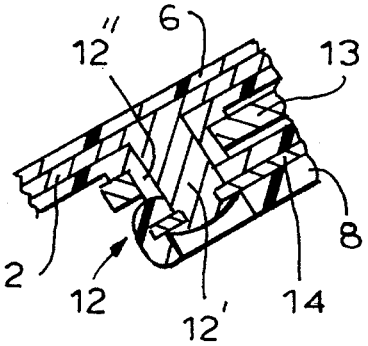
FIG. 1c
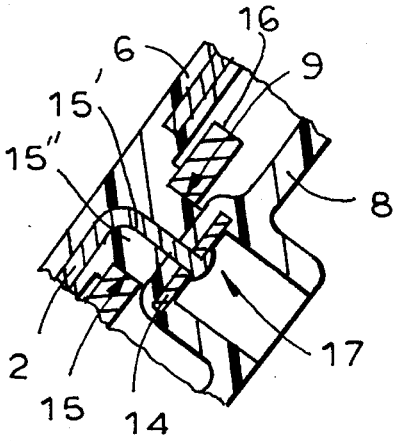
FIG. 1d
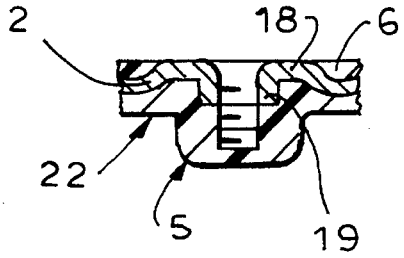
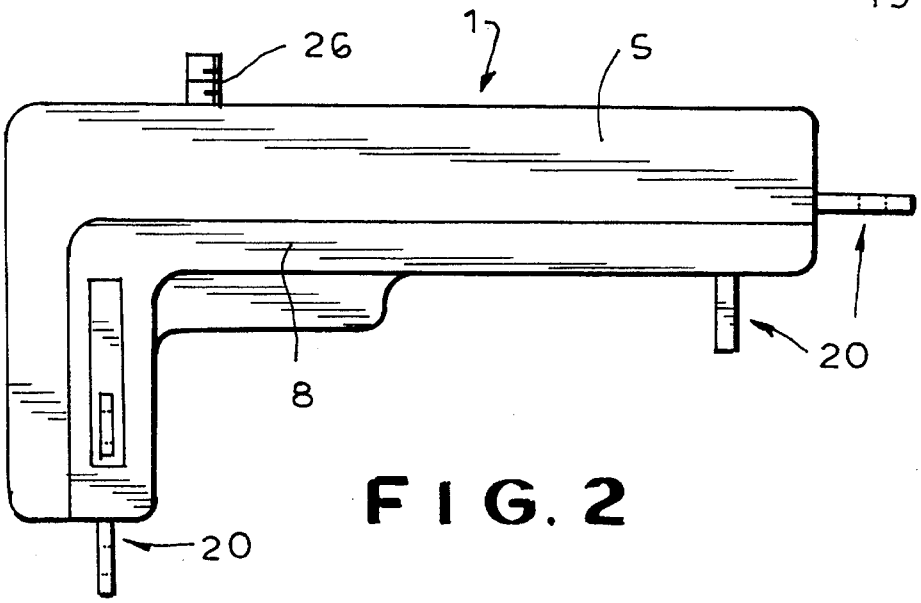
FIG. 2

MOTOR-VEHICLE DOOR LATCH WITH COMPOSITE HOUSING

FIELD OF THE INVENTION

The present invention relates to a motor-vehicle door latch. More particularly this invention concerns the housing that holds the various levers, pawls, and other mechanism of such a latch.

BACKGROUND OF THE INVENTION

A standard motor-vehicle door latch has a housing constituted as a metal plate that is bolted to the door edge and that is fitted with various metallic pivot pins that carry the operating links and levers, latching fork, retaining pawl, and springs of the latch. The metal plate may be formed with a raised edge so that it can fit together with a cover plate to form a closed housing, or can be flat and fitted with a plastic cover to form such a closed housing.

In any case the manufacture of the basic metal housing is fairly complex, in large part because it must be very durable. The pivots and stops for the mechanism of the lock must be carefully mounted on the plate at precisely controlled locations or the latch will not work. Thus this item is a fairly expensive part of the door latch.

OBJECTS OF THE INVENTION

It is therefore an object of the present invention to provide an improved housing for a motor-vehicle door latch.

Another object is the provision of such an improved housing for a motor-vehicle door latch which overcomes the above-given disadvantages, that is which is inexpensive to manufacture, even to high tolerances, yet which has a service life as good as that of the prior-art latches.

SUMMARY OF THE INVENTION

A motor-vehicle door latch has according to the invention a molded synthetic-resin or plastic housing having a floor side plate, a perimeter wall projecting laterally from an inside face of the plate, and a cover plate. The housing is unitarily formed with a plurality of pivots. Mechanism inside the housing includes a latching fork, a latching pawl, and operating levers mounted on respective pivots. In accordance with the invention a metal reinforcing plate is imbedded in the floor side plate only in the region of the fork and pawl and is unitarily formed with upstanding tabs extending into and imbedded in the pivots of the fork and pawl only. The pivots of the operating levers are substantially wholly formed of the plastic of the housing.

Thus with this system the critical regions of the lock housing, that is where the locking fork and retaining pawl are mounted, are reinforced with a metal, normally steel, plate, so that they are very strong and can withstand the enormous stresses they are subjected to generally continuously during normal use. On the other hand the operating levers, which are only loaded when the doors are opened and closed, are mounted on wholly plastic pivot pins which are amply strong for this purpose.

The main advantage of the system according to this invention is that the housing can be made at low cost but with very great accuracy, since it is possible to injection mold this complex shape easily whereas constructing it wholly out of metal is a complex job. Even though the bulk of the housing is of injection-molded synthetic-resin construction, the critical elements are solidly reinforced so that the resultant part is at least as good as the prior-art structures. In fact the latch is substantially lighter and operates much more quietly than the prior-art latches.

According to a further feature of this invention the housing includes a plastic cover provided with an imbedded metal plate. This cover-reinforcement plate is formed with formations to which are fitted the tabs of the metal floor plate. Thus the pivots for the fork and its retaining pawl are solidly mounted at both ends, even though the fork and pawl themselves ride on synthetic-resin surfaces.

In accordance with a further feature of this invention the floor-wall reinforcement plate is formed with a plurality of threaded holes by means of which it is bolted to the respective door edge. In fact this plate is formed adjacent each of these holes with a raised portion that is not covered by plastic in the finished assembly. This raised portion not only serves for solid metal-to-metal contact of the reinforcement plate with the door edge in the finished installation, but during molding can directly abut an inside surface of the mold to ensure that it is perfectly positioned therein. In fact during such molding the threaded bolt holes can be fitted with threaded elements that both ensure solid holding and positioning of this plate, and that also prevent resin from blocking the holes.

BRIEF DESCRIPTION OF THE DRAWING

The above and other objects, features, and advantages will become more readily apparent from the following description, reference being made to the accompanying drawing in which:

FIGS 1*a*, 1*b*, 1*c*, and 1*d* are sections taken along respective lines Ia—Ia, Ib—Ib, Ic—Ic, and Id—Id of FIG. 1;

FIG. 2 is a top view taken in the direction of arrow II of FIG. 1; and

SPECIFIC DESCRIPTION

Figure 1:
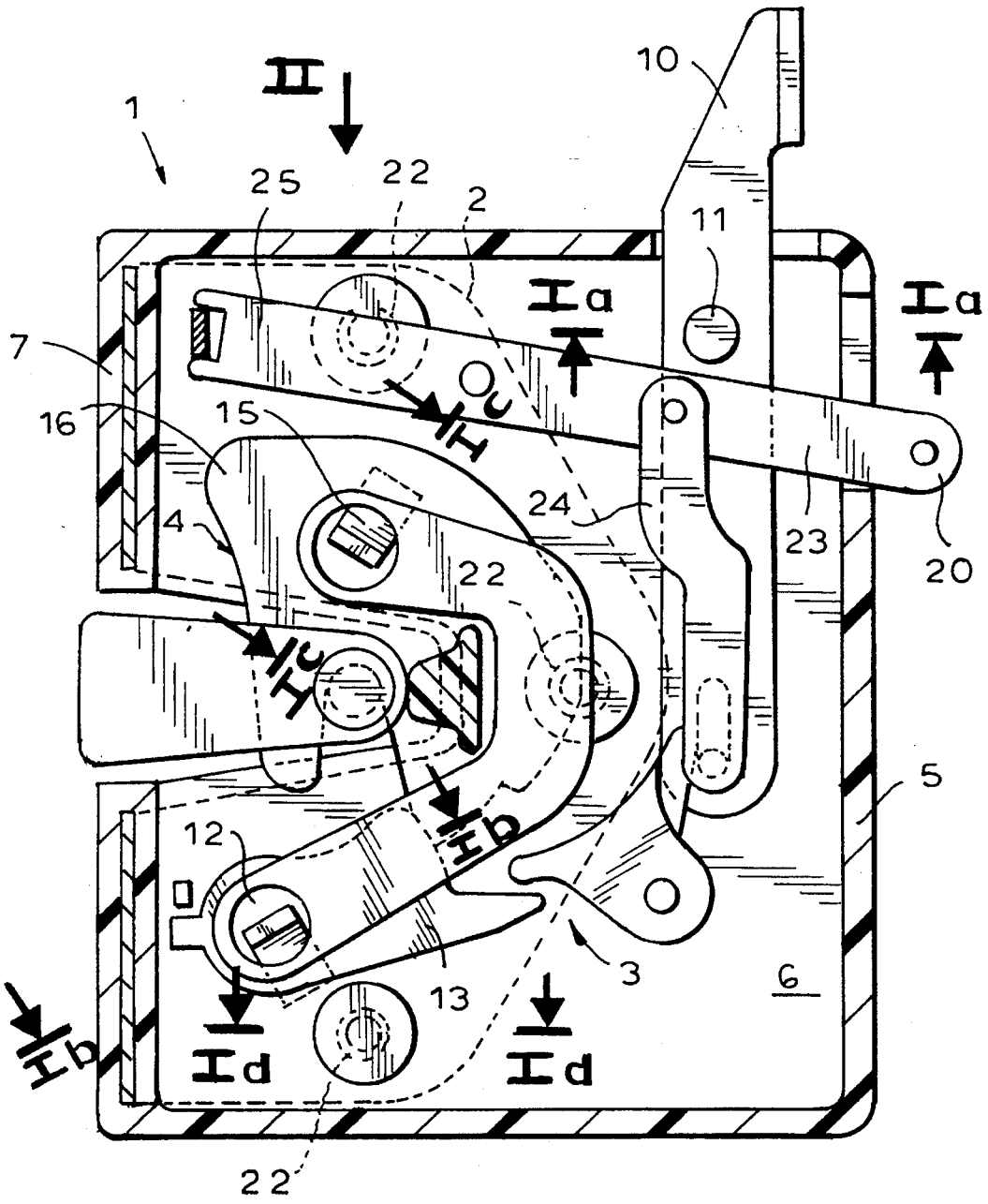
FIG. 1 is a vertical section through the latch according to this invention with some parts removed for clarity of view.

As seen in FIGS. 1 and 2 a motor-vehicle door latch 1 according to this invention has a synthetic-resin housing 5 having a floor or side wall 6 in which is imbedded a small mainly flat steel plate 2, an edge or perimeter wall 5 extending laterally from the floor wall 6, and a cover or side wall 8 also made of plastic. The housing 5 contains door-latching parts 4 here including a standard fork 16 and pawl 13, and levers 10, 23, 24, and 25 which are connected to inside and outside door handles, an inside lock button, and an outside lock cylinder and which have exposed ends shown at 20 in FIG. 2. The mechanism inside the housing 5 is generally standard.

According to the invention the plate 2 is confined to a region 3 corresponding to pivots 12 and 15 for the pawl 13 and fork 16 and threaded connection holes 22 and extends transversely up in a front part 7 of the wall 5. The rest of the housing 5 and the cover 8 are entirely made of a durable plastic that is injection molded around the steel plate 2. This plate 2 can be integrally formed with threaded studs 26 (one shown in FIG. 2) that project out past the plastic covering and allow the housing 5 to be mounted solidly on a door edge.

FIG. 1*a* shows how the pivot 11 for the outside locking lever 10 is formed by a boss 11' having a male outer end formed on the floor 6 and a similar boss 11" having a complementary female outer end and formed on the cover 8. The parts 11' and 11" fit together to form the pivot 11 for the lever 10.

FIG. 1*b* shows how the pivot 12 for the pawl 13 is formed by a tab 12' that is punched out of and bent up from the plate 2 and that is surrounded by an integral collar 12" of synthetic-resin material unitary with the floor 6. The rectangular-section outer end of the tab 12' fits through a complementary rectangular slot or formation in a reinforcement bar or plate 14 imbedded in the cover 8 and is headed over like a rivet to secure it permanently therein. Thus the cylindrical pivot 12 is reinforced by a piece of steel that extends through its center and that is unitary at one end with the plate 2 imbedded in the floor 6 and is solidly joined at its outer end with another steel plate 14 imbedded in the cover 8.

FIG. 1*c* shows a similar construction for the pivot 15 of the fork 16. A tab 15' that is punched out of and bent up from the plate 2 is surrounded by an integral collar 15" of synthetic-resin material unitary with the floor 6. The outer end of the tab 15' fits through a complementary slot in the plate 14 imbedded in the cover 8 and is headed over like a rivet to secure it permanently therein. Two critical parts—the fork 16 and the pawl 13—are therefore secured to extremely robust pivots for maximum safety, while the remaining levers 10, 23, 24, and 25 can be secured at unreinforced plastic pivots such as the pivot 11.

FIG. 1*d* shows how each mounting hole 22 is formed by an annular raised part or groove 18 and a concentric upstanding rim or collar 19 that is internally threaded. The base of the welt 18 is offset from the plane of the plate 2 so that it is exposed around the hole 22, that is the plastic of the housing 5 does not cover the plate 2 immediately around each hole 22 on the outside face of this plate 2. This structure makes it possible to mount the stamped plate formed with the two tabs 12' and 15' in a mold with great accuracy, for injection-molding the rest of the main housing 5 around it. Furthermore the finished housing 5 can then be bolted with great accuracy to a door edge using the holes 22 and gaining solid metal-to-metal contact around these holes 22.

Figure 3:
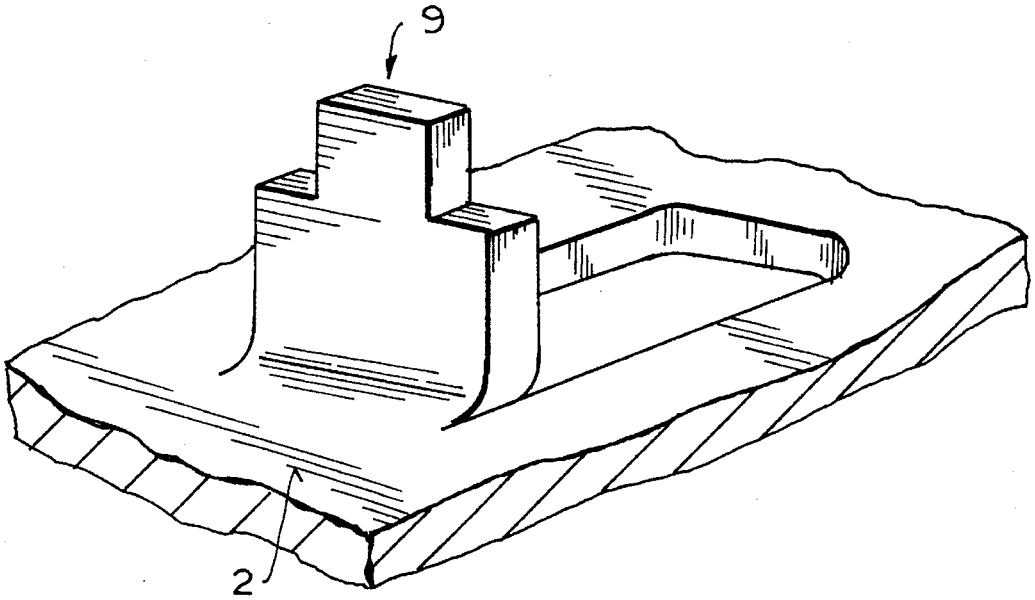
FIGS. 3 and 4 are large-scale perspective views of a detail of the invention as it is manufactured.
Figure 4:
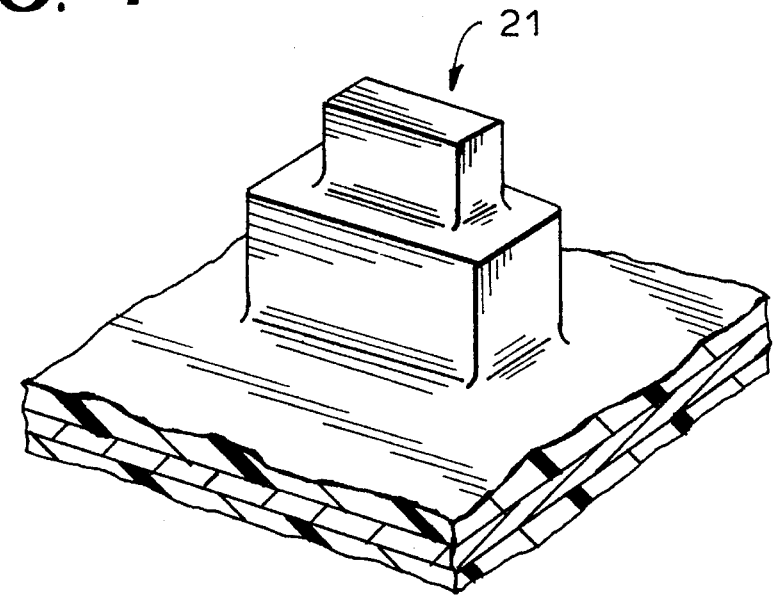

FIGS. 3 and 4 show how the pivots 12 and 15 can be made by bending up a tab 9 from the plate 2 and then surrounding it with plastic, leaving only an exposed tip 21 for fitting through a complementary slot of the cover reinforcement plate 14.

I claim:

1. A motor-vehicle door latch comprising:

a molded synthetic-resin housing having a floor, a perimeter wall projecting laterally from an inside face of the plate, and a cover, the housing being unitarily formed with a plurality of pivots;

mechanism inside the housing including a latching fork, a latching pawl, and operating levers mounted on respective pivots; and a metal floor plate imbedded in the floor only in the region of the fork and pawl, generally entirely surrounded by the resin of the housing, and having upstanding tabs punched from the plate extending into and imbedded in the pivots of the fork and pawl only.

2. The motor-vehicle door latch defined in claim 1 wherein the pivots of the operating levers are substantially wholly formed of the synthetic resin of the housing.

3. The motor-vehicle door latch defined in claim 1 wherein the cover includes an imbedded metal plate.

4. The motor-vehicle door latch defined in claim 3 wherein the imbedded metal plate of the cover is provided with formations to which are fitted the tabs of the metal floor plate.

5. The motor-vehicle door latch defined in claim 1 wherein the metal plate is formed with threaded holes adapted to receive mounting bolts.

6. The motor-vehicle door latch defined in claim 5 wherein the metal plate is formed adjacent each hole with a raised portion extending to an outer surface of the floor plate, the metal plate being substantially wholly covered by and imbedded in the synthetic resin of the housing except at the raised portions.

7. The motor-vehicle door latch defined in claim 1 wherein the reinforcement is unitarily formed with at least one threaded stud, whereby the stud can be used to mount the housing on a door edge.

8. The motor-vehicle door latch defined in claim 1 wherein the floor plate has an upstanding edge portion imbedded in a portion of the perimeter wall.

9. The motor-vehicle door latch defined in claim 1 wherein the tabs are of the same thickness as the floor plate and the plate is formed adjacent each tab with a through-going hole.

* * * * *